United States Patent [19]

Farcasiu et al.

[11] Patent Number: 4,784,746

[45] Date of Patent: Nov. 15, 1988

[54] CRUDE OIL UPGRADING PROCESS

[75] Inventors: Malvina Farcasiu, Flemington; Rene B. LaPierre, Medford, both of N.J.

[73] Assignee: Mobil Oil Corp., New York, N.Y.

[21] Appl. No.: 41,188

[22] Filed: Apr. 22, 1987

[51] Int. Cl.[4] ..... C10G 9/00

[52] U.S. Cl. ..... 208/106; 208/46; 585/470; 585/643

[58] Field of Search ..... 208/106, 46, 133, 157; 585/446, 470, 323, 643

[56] References Cited

U.S. PATENT DOCUMENTS

| | | | |
|---|---|---|---|
| 2,383,772 | 8/1945 | Chaney et al. | 208/106 |
| 3,145,238 | 8/1964 | Kestner | 208/106 |
| 3,525,776 | 8/1970 | Berger | 585/323 |
| 3,767,564 | 10/1973 | Youngblood et al. | 208/15 |
| 4,085,034 | 4/1978 | Endo et al. | 208/106 |
| 4,317,712 | 3/1982 | Farcasiu | 585/474 |
| 4,389,303 | 6/1983 | Simo et al. | 208/56 |
| 4,522,703 | 6/1985 | Yan et al. | 208/40 |
| 4,524,230 | 6/1985 | Haensel | 585/446 |
| 4,560,467 | 12/1985 | Stapp | 208/106 |
| 4,592,830 | 6/1986 | Howell et al. | 208/56 |
| 4,599,470 | 7/1986 | Gregory et al. | 585/323 |
| 4,615,791 | 10/1986 | Choi et al. | 208/106 |
| 4,629,817 | 12/1986 | Farcasiu | 585/470 |

*Primary Examiner*—Anthony McFarlane
*Attorney, Agent, or Firm*—Alexander J. McKillop; Michael G. Gilman; Robert B. Furr, Jr.

[57] ABSTRACT

A crude oil is upgraded by thermal treatment at a temperature of at least 400° C. under at least autogenous pressure and preferably from 100 to 1000 psig for about 20 to 30 minutes in order to increase the proportion of distillable components in the crude. The improvement is attributed to alkylation of lower molecular weight components, especially aromatics, by alkyl groups derived from the high boiling component of the crude. The process reduces the nondistillable residue and enables subsequent processing to be carried out with lower gas and coke make. The process may be operated with a whole crude or a topped crude as feed.

9 Claims, 1 Drawing Sheet

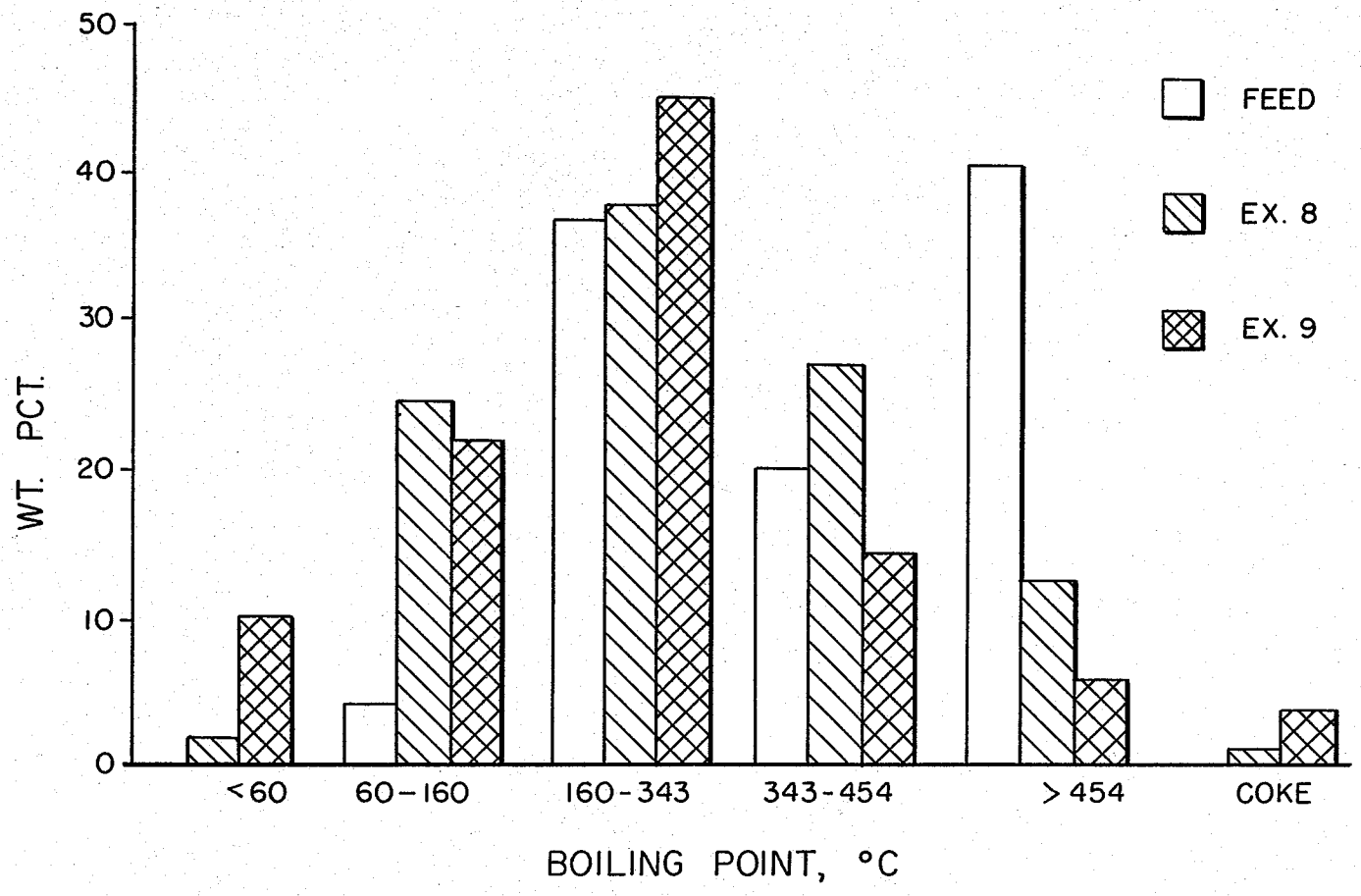
FEED
EX. 8
EX. 9
WT. PCT.
50
40
30
20
10
0
<60
60-160
160-343
343-454
>454
COKE
BOILING POINT, °C

CRUDE OIL UPGRADING PROCESS

FIELD OF THE INVENTION

This invention relates to a method of upgrading a crude oil, and more particularly, to a method of upgrading a whole or topped crude oil so as to improve its properties and the properties of products obtained from it by subsequent refining steps.

BACKGROUND OF THE INVENTION

Traditionally, crude oils are first distilled and then processed further as separate fractions. Conventionally, distillation is initially carried out under atmospheric pressure to produce various distillate fractions including naphtha and middle distillates, as well as an atmospheric residuum or "long" residuum which is then subjected to further distillation under vacuum to produce additional quantities of distillate material togehter with a vacuum residuum or "short" residuum. This processing scheme which initially separates the components of the crude according to their boiling points has conventionally been regarded as satisfactory because it enables the processing steps which follow the fractionation to be formulated according to the requirements of the individual fractions which vary not only according to their distillation characteristics but also in their chemical compositions.

It has now been found, however, that conventional processing schemes of this kind are not entirely favorable in that desirable reactions between components of different boiling ranges in the original crude may be carried out at an early stage and the characteristics of the treated crude may be favorably affected.

SUMMARY OF THE INVENTION

It has now been found that when a whole or topped crude is subjected to thermal treatment, alkylation of low molecular weight acceptor molecules produces a treated product which may be subsequently subjected to conventional refining treatment with improved results. In particular, the initial thermal processing of the crude increases the non-residual content of the crude and also enables subseqeunt refining operation to be carried out with reduced coke and light gas made, resulting in a greater economic utilization of the original crude fractions. The treatment also effects a demetallation.

According to the present invention there is therefore provided a crude oil upgrading process in which a whole or topped curde is subjected to thermal treatment at an elevated temperature and pressure to increase the distillable portion of the crude. It is believed that the improved results are obtained by a transalkylation process which is effected between the alkyl portions of the higher boiling components of the crude and the lower boiling alkyl-acceptor molecules which are present in the lower boiling portions of the crude, especially easy-to-alkylate aromatics, such as benzene, toluene and other aromatics such as pyrene or adamantane as well as by isoparaffins which, upon alkylation, form higher paraffins which are extremely desirable components for lube production.

The thermal treatment is preferably carried out at a temperature of at least 300° C. and in most cases, temperatures of at least 400° C. will give the desired improvement at acceptably short reaction times. Reaction times of at least 5 minutes will normally be required and at the preferred conditions a maximum of 60 minutes will be sufficient and in most cases, significantly shorter, for example, 20 or 30 minutes. The pressure should be equal to at least the autogenous pressure in order to maintain the low molecular weight components in the liquid phase so that the desired transalkylation reactions will occur. Generally, pressure will be at least 100 psig and preferably at least 400 psig. Depending upon the selected reaction temperature, pressure may be as high as 1000 psig or even higher.

THE DRAWINGS

The single FIGURE of the accompaning drawings is a diagram showing the boiling range shifts which occur on thermally treating a topped crude.

DETAILED DESCRIPTION

The present upgrading process may be used with whole or topped crudes; but because it is necessary to maintain a sufficient quantity of low molecular weight acceptor components in the crude, the feed should contain at least some components boiling in the naphtha boiling range or lower, ie. below about 330° F. (about 165° C.). Normally there will be no large amount of $C_{6-}$ components but these are not excluded. Thus, the feed will normally be a $C_{6+}$ feed, typically with an initial boiling point (IBP) of at least 60° C., and with a boiling range up to at least 450 ° C. The low boiling component (330° F.−, 165° C.−) should have a substantial aromatic component so as to provide a significant quantity of low molecular weight aromatics which are relatively easily alkylated under the selected treatment conditions. Thus, the feed for the present process should preferably include at least 2 and preferably at least 5 percent by weight of component boiling below 330° F. (about 165° C.) of which at least 20% by weight are preferably aromatic components. Thus, if a topped crude is employed, a sufficient quantity of lower boiling components should be retained in order for the treatment to be satisfactory. The middle distillate portion of the feed (about 330°-650° F., about 165°-345° C.) preferably comprises at least 20 weight percent or more of the feed, e.g. 25 to 50 weight percent and usually 25 to 40 weight percent, in order to provide further quantities of aromatic acceptors for the long-chain alkyl groups removed from the higher boiling components by the thermal treatment. Although this portion of the feed is affected less by the process than the lighter components, a significant increase in this portion may be obtained, especially at higher severity conditions. The remaining distillate portion of the feed, usually in the 650°-1000° F. (about 345°-540° C.) range will together with residual components constitute the balance of the feed with the distillate fraction generally constituting at least 10 weight percent of the feed, depending on crude origin. Residual components (atmospheric) will typically constitute at least 20 weight percent of the feed, again depending on crude origin.

Generally, light crudes will benefit the most from the present treatment since they contain relatively larger quantities of the low molecular weight acceptor molecules which participate in the transalkylation reactions to improve the quantity of distillable materials in the crude. Thus, light grade crudes such as Arab Light and Alaska may be used although aromatic feeds such as Alaskan crude which contains significant quantities of low molecular weight aromatics are preferred, since these will participate most readily in the desired alkylation reactions. However, paraffinic crudes such as North Sea, Libyan and Pacific Basin and Mainland Chinese crudes may also be employed, since the low molecular weight components in these are also capable of being alkylated by the alkyl components of the heavier materials present in the crude, although possibly under less favorable conditions. However, it is recognized that refineries frequently use mixtures of crude oils and with the increasing frequency of changes in the sources of oil under present markets, the present process will have the advantage of producing a more constant quality of oil by chemical interactions between components of various origins. Thus, the present initial upgrading process by reducing the quantity of heavy fractions as well as by demetallation is of particular utility in current refinery operation.

The objective of the process is to increase the proportion of the middle boiling range, distillable fractions in the feed. It has been found that when whole crudes are subjected to the present thermal treatment, the quantity of residual materials, ie. nondistillable materials, decreases substantially while the levels of gas formation and coke formation are relatively low. As the quantity of resid decreases, the quantity of distillable material increases, particularly in the valuable naphtha and middle distillate range from about 60°-345 ° C. Depending upon the exact conditions chosen with an individual crude or crude mixture, relatively greater increases in the content of naphtha (to about 165° C.) relative to middle distillate or gas oil (about 345°-455° C.) may be noted, as shown below.

As mentioned above, the feed is subjected to thermal treatment in the liquid phase under at least autogenous pressure, preferably at temperatures of at least 400° C. and usually in the range of 425°-450° C. Temperatures above about 500° C. are usually not preferred because of the increase in pressure which will be needed in order to maintain the lower molecular components in the liquid phase at such temperatures and because of the likelihood of causing excessive coke and like gas formations under these conditions. Pressure will be generally at least 100 psig and will normally range up to about 1000 psig, and usually will be about 400 psig. However, pressure is not critical in itself except in so far as there is a necessity to maintain liquid phase operation. The duration of the treatment should be adjusted according to the nature of the feed and of the crude origin in order to maximize the increase in distillable fractions and this may be done by a process of empiricism. Generally, reaction durations of 5-30 minutes will be sufficient, with shorter reaction times being possible at higher temperatures. The reaction may be carried out either in a closed vessel in batch operation or in continuous operation by employing a closed reactor which will provide an adequately long average residence time at the selected temperature.

As discussed above, it is believed that the upgrading of the present crude feeds is obtained as a result of alkylation reactions which take place at the elevated temperatures employed. Experimental work with model compounds has shown that the amounts of polynuclear aromatic compounds and coke formed during pyrolysis of alkyl aromatics are substantially decreased if significant quantities of small molecules with good acceptor properties or small free radicals are available in a closed system. The crude feeds used in the present process provide this type of environment and accordingly, a shift in the composition of the feed towards the more valuable, distillate fractions from the high boiling resids takes place. Analysis of the light materials ($C_{6-}$) formed during the process shows that the hydrocarbons which are formed during the operating process are mainly saturated and that isoparaffins are present together with normal paraffins. Because isoparaffins can be formed only from isofragments which are already present in the heavier fractions or, at least partially, from thermal isomerization, it is believed that the presence of long-chain, branched fragments in the higher boiling materials contributes to the formation of the isoparaffins which are detected in the upgraded products. Alternatively, thermal isomerization may account for at least some of the isoparaffins which have been noted. Thus, the isoparaffins in the product may be derived from n-alykl aromatics in the feed which have been subjected to thermal isomerization.

The residual, nondistillable fraction of the feed is reduced by a significant quantity during the upgrading process, typically by at least 50 wt % and in most cases by at least 60 wt %. Reductions in the residuum quantity by 75% are possible, especially at higher temperature operation, albeit at a slight increase in the quantity of coke formed. Concomitantly, the metal content of the treated oil is reduced by a significant amount, typically be at least 50 wt % (based on coke analysis) or even higher. Furthermore, with the shift to distillates from residual materials, subsequent processing is improved and the quantities of the more valuable naphtha, middle distillate and gas oil products increased by significant amounts.

EXAMPLES 1-3

Various n-alkybenzenes were used in pyrolysis experiments of model compounds. The experiments were performed in sealed, thick wall, glass tubes which were maintained in an oven at 454° C. for 40 minutes. The reaction products were analyzed by GC/MS on a Hewlett-Packard 5992A instrument and by GC on Dexyl and OV17 columns. The experimental results are given in Table 1 below.

TABLE 1

| Ex. | Compound | Conversion % | Composition Pyrolysis Products, % (Note) |
|---|---|---|---|
| 1 | n-butylbenzene | 85 | 50 I |
| | | | 19 II |
| | | | 31 III |
| 2 | n-octylbenzene | 98 | 64 I |
| | | | 24 II |
| | | | 12 III |
| 3 | n-dodecylbenzene | 88 | 74 I |
| | | | 23 II |
| | | | 3 III |

Note:
I = Paraffins, olefins and alkylbenzenes
II = Naphthalenes, methylnaphthalenes and biphenyls
III = Polynucleararomatic hydrocarbons The compounds in Group I above are compounds with molecular weights lower than the starting material. Both the paraffins and the other hydrocarbons were isomerized and the majority of the remaining nonaromatic hydrocarbons were paraffins. The olefins very likely react by further alkylating aromatic structures present in the mixture.

Among the compounds in Group II, naphthalene is the major constituent and of the polyaromatics formed during pryrolysis, highly condensed aromatic hydrocarbons such as fluorene, pyrene and their alkyl derivatives are present in small quantities, with phenylnaphthalenes and terphenyl being the major constituents.

EXAMPLES 4–7

In a separate set of experiments binary mixtures of n-octylbenzene were heated with two thermally stable hydrocarbons, pyrene and adamantane, to determine whether pyrene or adamantane interacts with the pyrolysis products of alkylbenzenes to form new reaction products. For comparison, a mixture of n-decane and n-octylbenzene was pyrolized under the same conditions to determine whether there is any interaction between the products or intermediates formed at the simultaneous pyrolysis of an alkylbenzene and a paraffin.

The results are given in Table 2 below. Pyrolysis of n-octylbenzene in the presence of added hydrocarbons gave practically no char.

TABLE 2

Composition of the Products Formed at the Pyrolysis of of n-Octylbenzene in the Presence of Added Hydrocarbons Pyrolysis Conditions: 454° C., 40 min., Sealed Glass Tube Ratio n-Octylbenzene:hydrocarbon, 1:1 (by wt. %)

| Ex. | Added Hydrocarbon | Composition Pyrolysis Products (Note) |
|---|---|---|
| 4 | Pyrene | 69% IV |
| | | 7% II |
| | | 2% III |
| | | 22% alkylpyrenes |
| 5 | Adamantane | 63% IV |
| | | 14% alkyl-adamantanes |
| | | 22% alkyl-aryl-adamantanes |
| 6 | n-Decane | 85% I |
| | | 10% II |
| | | 5% III |
| 7 | None | 64% I |
| | | 24% II |
| | | 12% III |

The composition is normalized for the products formed from both starting materials.

Note:
I = Paraffins, olefins and alkylbenzenes
II = Naphthalenes and biphenyls
III = Polynucleararomatics
IV = Paraffins and alkylbenzenes The acyclic hydrocarbons produced in the reaction were overwhelmingly paraffins. In the case of pyrene and adamantane, the reaction products suggest the alkylation of these hydrocarbons with fragments formed during pyrolysis of n-octylbenzene. As the life of the alkyl free radicals is quite short, it is possible that the formation of alkylpyrenes and alkyladamantanes is due, at least in part, to the alkylation with olefins formed during pyrolysis, consistent with the absence of olefins in any appreciable amounts at the pyrolysis of n-octylbenzene in the presence of pyrene or adamantane. The stabilization of the reactive species (olefins or free radicals) by pyrene or adamantane may be responsible also for the decrease in the concentration of naphthalenes and polyaromatic compounds (Table 2) and for the absence of char. When n-octylbenzene is pyrolyzed in presence of n-decane there was no noticeable effect on the quantity of naphthalenes and polynuclearaomatics formed as compared to n-octylbenzene alone (after corrections for actual concentration).

The results noted above showed that the polynuclearaomatic compounds and coke formed during pyrolysis ofalkylaromatics is substantially decreased if large quantities of small molecules (with good acceptor properties) or small free radicals are available in a closed system. Whole crude oils can provide this kind of environment, as shown in Examples 8 and 9 below.

EXAMPLES 8 AND 9

A topped (80° C.+) Prudhoe Bay crude oil was heated in a stirred autoclave under the conditions given in Table 3 below. At the end of the run the gas was analyzed by GC/MS. The liquid was filtered and analyzed by simulated distillation. The coke, separated by filtration, was washed with methylene chloride, tetrahydrofuran, and methylene chloride, then dried and subjected to elemental analysis.

TABLE 3

| | Crude Thermal Treatment | | | |
|---|---|---|---|---|
| Ex. | Temp, °C. | Initial $H_2$ Pressure, psig (kPa.abs) | Max Pressure at Reaction Temp, psig (kPa.abs) | Time at Reaction Temp., min. |
| 8 | 425 | 100 (790) | 460 (3170) | 30 |
| 9 | 450 | 300 (2170) | 1100 (7585) | 20 |

The mass balance of the runs and the boiling point distribution of the initial oil and the reaction products are given in Table 4 and the FIGURE.

TABLE 4

| | | Boiling Point Distribution, Wt. % | | | | | |
|---|---|---|---|---|---|---|---|
| | | 60– | 60–160° C. | 160–343° C. | 343–454° C. | 454° C.+ | Coke |
| Ex. | Topped Crude | 0 | 4.0 | 36.3 | 20.1 | 39.6 | 0 |
| 8 | Product | 2 | 24.6 | 36.9 | 26.6 | 11.9 | 1 |
| 9 | Product | 10.4 | 21.8 | 44.5 | 14.3 | 5.7 | 3.3 |

The data in Table 4 shows that the coke formation in Ex. 8 is 1% of the topped crude used in the experiment (i.e. about 0.9% of all crude) and the 454° C.+ fraction is reduced by 70%. In Ex. 9 the 454° C.+ fraction is reduced by 85% with about 3% coke formation. Concomitantly, the Ni and V content of the treated oil was reduced by 70% (based on coke analysis).

The experimental data also showed that after thermal treatment the quantity of heavy resid (454° C.+) decreased substantially while levels of gas formation and coke formation cold be kept low. GC/MS data of light materials ($-C_6$) show that the newly formed hydrocarbons are mainly saturated and that isoparaffins are present together with the normal paraffins: in Ex. 9, the ratio saturated:unsaturated is approximately 17.5:1 and for $C_5$ hydrocarbons the ratio n-$C_5$:i-C5 is 1.3:1.

If processed in the traditional way (i.e. by distillation and coking of the vacuum resid), the Prudhoe Bay crude would give about 7% coke as a percent of all crude. The reduction in coke thereafter offers a technological and economical advantage over the usual technology.

We claim:

1. A process for upgrading a crude oil which comprises heating a feedstream consisting essentially of a crude oil wherein said crude oil contains at least 2 weight percent of hydrocarbon components boiling below 330° F. of which at least 20 weight percent are aromatic compounds in the liquid phase, said feedstream being heated at a temperature of at least 400° C. and under pressure sufficient to maintain the feedstream in the liquid phase to effect an increase in the proportion of non-residual components in the crude oil wherein said proportion is increased by a transalkylation process.

2. A process according to claim 1 in which the crude oil comprises a whole crude.

3. A process according to claim 1 in which the crude oil comprises a topped crude.

4. A process according to claim 3 in which the topped crude has an initial boiling point no lower than 60° C.

5. A process according to claim 1 in which the crude oil has a boiling range extending from the boiling point of a $C_6$ hydrocarbon to at least 450° C.

6. A process according to claim 1 in which the crude oil is heated to a temperature from 425° C. to 450° C.

7. A process according to claim 1 in which the crude oil is heated to a temperature of at least 400° C. under a pressure of at least 100 psig for at least 15 minutes.

8. A process according to claim 7 in which the crude oil is heated to a temperature of at least 400° C. for 20 to 30 minutes under a pressure of at least 100 psig.

9. A process according to claim 8 in which the pressure is at least 400 psig.

* * * * *